United States Patent [19]

James

[11] Patent Number: 4,877,242

[45] Date of Patent: Oct. 31, 1989

[54] APPARATUS FOR PLAYING BILLIARDS OR POOL

[76] Inventor: Jewell P. W. James, 4305 1/2 Lummi Shore Rd., Ferndale, Wash. 98248

[21] Appl. No.: 108,626

[22] Filed: Oct. 15, 1987

[51] Int. Cl.[4] ..... A63D 13/00

[52] U.S. Cl. ..... 273/2; 273/68; 273/129 R; 2/161 A

[58] Field of Search ..... 2/160, 161 A; 273/68, 273/18, 2, 23, 24, 119 R, 129 R

[56] References Cited

U.S. PATENT DOCUMENTS

| | | | |
|---|---|---|---|
| Re. 16,272 | 2/1926 | Green | 2/160 |
| 552,171 | 12/1895 | Farnham | 273/18 |
| 586,373 | 7/1897 | Walker | 273/67 B |
| 3,123;832 | 3/1964 | Kubik | 2/161 A |
| 4,025,962 | 5/1977 | Hartung | 2/161 A |
| 4,042,975 | 8/1977 | Elliot | 2/161 A |
| 4,064,563 | 12/1977 | Stokes | 2/161 A |
| 4,253,660 | 3/1981 | Tiktin | 2/161 A |
| 4,519,781 | 5/1985 | Boyd | 2/160 |

*Primary Examiner*—Edward M. Coven
*Assistant Examiner*—Mark S Graham
*Attorney, Agent, or Firm*—Richard C. Litman

[57] ABSTRACT

An apparatus for playing billiards and pool including glove means that utilizes positionally arrayed cue adapters that have a cue inserting element that, in turn, gives a player a means for striking a cueball in the game of billiards and pool.

7 Claims, 2 Drawing Sheets

APPARATUS FOR PLAYING BILLIARDS OR POOL

FIELD OF THE INVENTION

This invention relates to the apparatus for playing or performing games of sport and, more particularly to the game of billiards or pool.

BACKGROUND OF THE INVENTION

The game of billiards or pool has been played for many years; and although many people have a billiard table in their homes, most play pool in poolhalls, taverns or recreational centers. Because pool can be played in any season and in any weather (especially indoors) its popularity is immense.

The present invention relates to the playing of billiards and pool and, specifically, relates to an alternative method of playing the game without a cue or cue stick.

This device further relates to the playing of billiards or pool with a special adapter of a cuestick that is worn on the hand and, more particularly, is an adaptation of the game of billiards and pool such as to play the game through the use of these hand-mounted cue adaptations.

DESCRIPTION OF THE PRIOR ART

The following cited references are found which relate to the construction of gloves that are adapted to the playing of various sports, and are found to be exemplary of the prior art. They are:

| U.S. Pat. No. | INVENTOR |
|---|---|
| 4,025,962 | Hartung |
| 4,064,463 | Stokes |
| 4,042,975 | Elliot |

U.S. Pat. No. 4,025,962, issued to Hartung, and Patent No. 4,064,463, issued to Stokes, disclose a glove construction that is to be worn by a pool player as the wearer is holding a cue. Both devices are so constructed so as to allow the user to more comfortably hold and slide the cuestick through the hand.

U.S. Pat. No. 4,042,975 to Elliot et al. discloses a glove construction so as to protect the hand in the course of playing in a sporting event, such as baseball. None of the prior art references taken singly or in combination disclose any construction or teach any apparatus that would read on the claims of the present device.

SUMMARY OF THE INVENTION

An object of the present invention is to provide an alternative to the standard cuestick when playing billiards or pool; that is, to provide a means for playing pool without recourse to the standard pool apparatus, the cuestick.

Another object of the present apparatus is to teach a construction in which the player utilizes a new and novel form of the game in which an alternative form of cue is utilized. This alternative form of cue being worn on the hand and more specifically being mounted on glove means for adaptation of the alternative cue apparatus to the game.

A further object of the present device is to provide for a variety of positional adaptations of the alternative cue means, such that the user may engage the billiard balls from a number of different positions, and likewise, may utilize the alternative construction of the game in a number of different ways.

A still further object of the present invention is to provide a construction for the adaptation of glove means for the increased comfort and utility of the device.

A very much further object is to provide a construction for the mounting of the alternative cue apparatus on any conventional glove such that the user may thereby engage the above mentioned alternative construction in a game of pool.

DESCRIPTION OF THE PREFERRED EMBODIMENT

Figure 1:
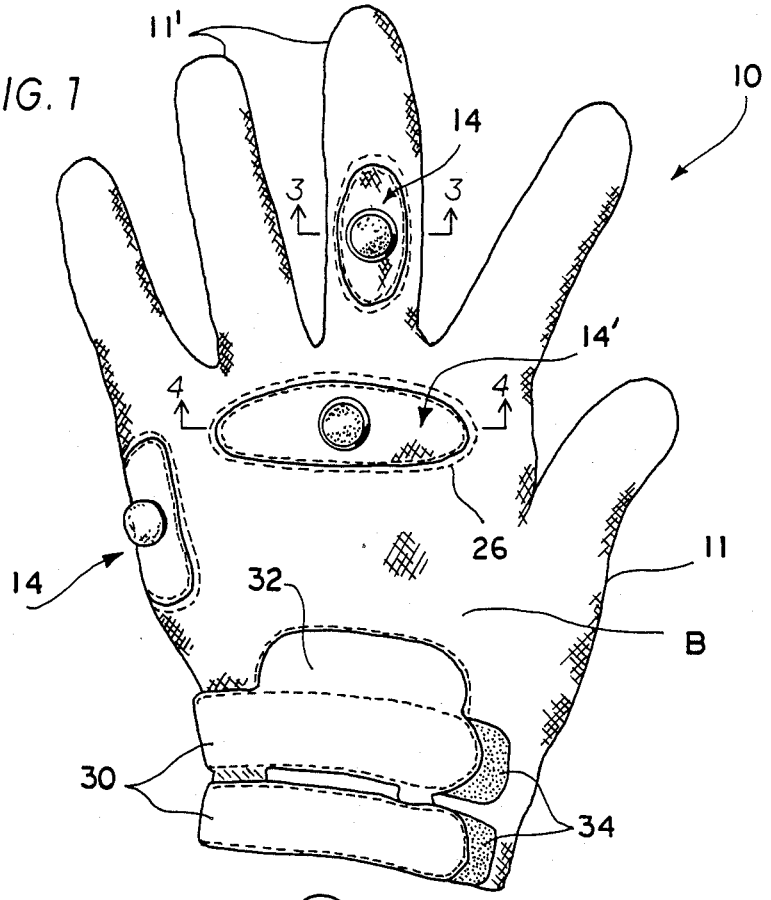
FIG. 1 is a plan view of the back of the device.
Figure 2:
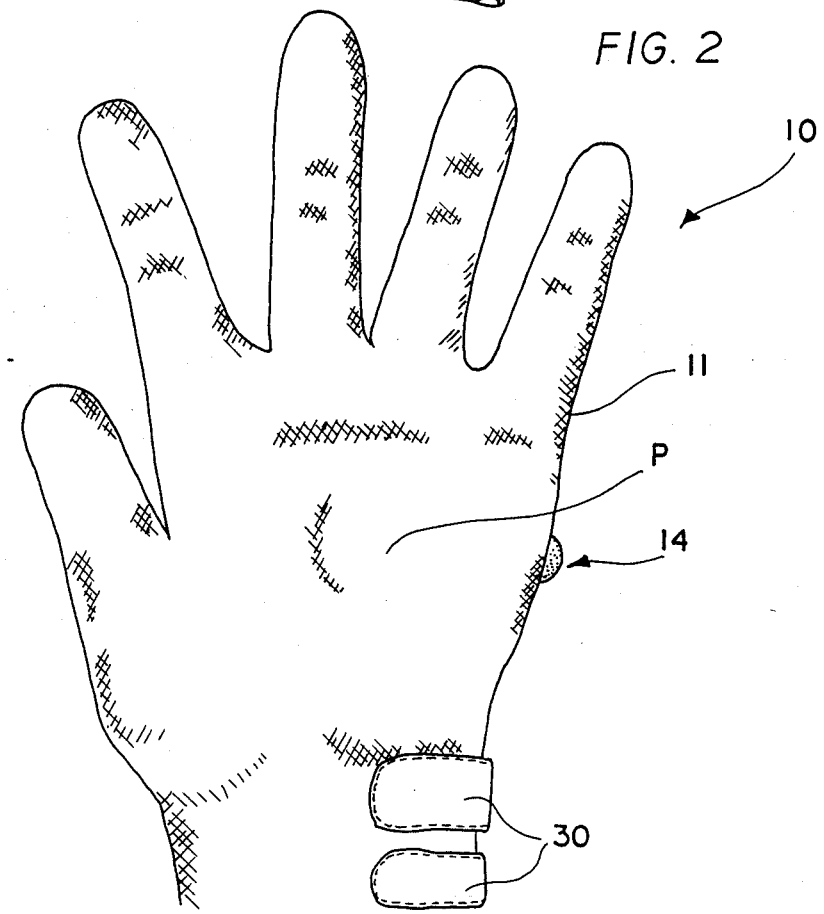
FIG. 2 is a bottom view showing the other or palm side of the glove.
Figure 3:
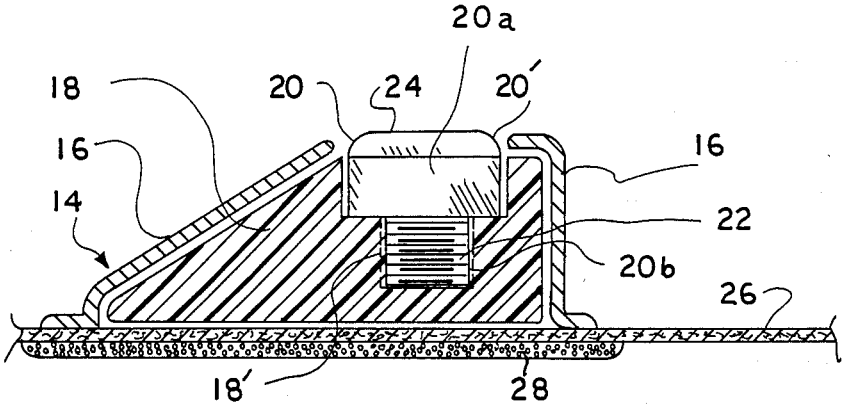
FIG. 3 is a detail section view, taken through a plane 3—3 of FIG. 2 illustrating a typical construction of the mounting means for the device.
Figure 4:
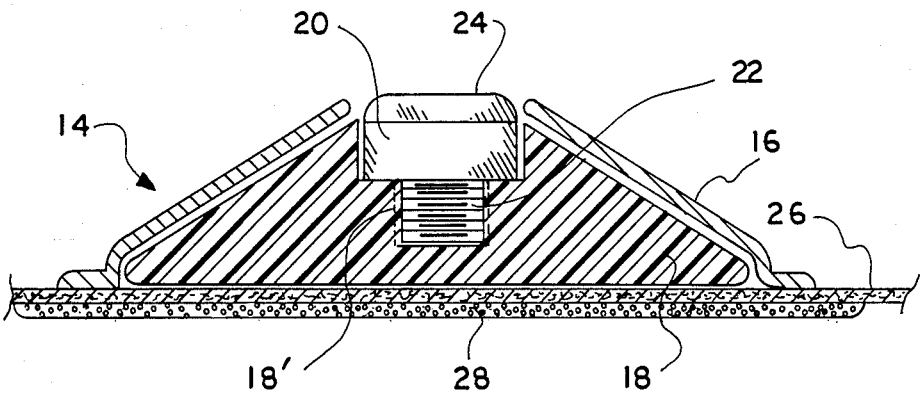
FIG. 4 is section view through 4-4 of FIG. 1.

Referring now to FIGS. 1 through 4, device 10 includes a glove 11, having typical finger projections 11' disposed thereon and a back B and palm P.

Cue adapters 14, 14' and 14" have an overlay, protective element 16 in which a molded, hardened substrate member 18 has fastening means 18' therein. Member 18 may be constructed of any suitable material such as plastic and functions to receive cue-insert element 20.

Cue-insert element 20 includes an enlarged head 20a joined to a reduced diameter shank 22 having fastening means, such as threads 20b for securing to the cooperating fastening means 18' and is thereby threaded into substrate member 18 through an opening 20' within the cue adapter protective element 16.

Each cue element 20 has cuecap 24 substantially overlaying cue element 20 and providing a suitable surface for the application of chalk and the playing of billiards or pool. Cue adapters 14, 14' and 14" are secured to adapter underlay member 26 by any suitable bonding or stitching means. Cue adapter underlay element 26 is likewise bonded or stitched to the glove 11.

A cue adapter 14 is disposed longitudinally along the back of at least one glove finger member 11' adjacent the area of a wearer's distal interphalangeal joint. Likewise, a cue adapter 14' is disposed transversely on the back of the glove 11 adjacent the area of a wearer's metacarpal phalangeal joints. Additionally, a cue adapter 14" may be longitudinally disposed along the edge of the glove 11, aligned with the little finger of the wearer. In this manner, there is provided a variety of different motion-shots by the user to the cueball.

Adjuster bands 30 are provided across the back of the glove 11, extending transversely over slotted opening 32 which extends upwardly along the back of glove 11 toward the knuckles of the hand. Adjuster bands 30 being substantially arrayed in parallel, one below the other and extending as shown in FIG. 1 downwardly from the back of the hand portion of glove 11 to the wrist. Adjuster bands 30 include fastening means 34 which can be of any well known adhesive type such as Velcro fasteners or buckle and loop fasteners for the adjustment, the tightening or loosening of the glove 11 on the hand.

Underlay member 26 with the associated cue adapter molded or stitched thereto may be deployed separate and subsequently affixed to any ordinary glove for the use in the game of billiards or pool. Underlay member 26 may be stitched or affixed to the glove by means of a heat treatment as with any suitable heat actuated adhesive layer 28.

The foregoing is considered illustrative only of the principles of the invention. Further, since numerous modifications and changes will readily occur to those skilled in the art, it is not desired to limit the invention to the exact construction and operation shown and described, and accordingly, all suitable modifications and equivalents which may be resorted to, fall within the scope of the invention.

What is claimed is:

1. An apparatus for playing the game of billiards or pool without a cuestick comprising;

a glove for use on a player's hand having a palm, back and finger projections, a cue adapter including a protective element having an opening disposed on said back of and attached to said glove, a substrate member captively disposed within said protective element and provided with fastening means, a cue insert element having a head joined to a shank, fastening means on said shank mating with said substrate member fastening means to provide attachment therebetween, and a cue cap on said cue insert head disposed at an elevation substantially spaced from said glove, whereby a wearer of said glove may strike a cue ball directly with said cue insert element cue cap as said substrate member absorbs the shock of such striking.

2. An apparatus according to claim 1 wherein, said shank defines a lesser diameter than said head.

3. An apparatus according to claim 1 wherein, said shank and substrate member fastening means comprise threads.

4. An apparatus according to claim 1 wherein, said cue adapter extends longitudinally of one said finger projection.

5. An apparatus according to claim 1 wherein, said cue adapter extends transversely of a wearer's metacarpal phalangeal joints.

6. An apparatus according to claim 1 including, at least one releasable adjuster band on said glove manipulatable to secure said glove about a wearer's hand.

7. An apparatus according to claim 4 wherein, said cue adapter is disposed adjacent a wearer's distal interphalangeal joint.

* * * * *